US009429861B2

(12) United States Patent
Terasaki

(10) Patent No.: US 9,429,861 B2
(45) Date of Patent: *Aug. 30, 2016

(54) ELECTROSTATIC CHARGE IMAGE DEVELOPING TONER AND METHOD FOR PRODUCING ELECTROSTATIC CHARGE IMAGE DEVELOPING TONER

(71) Applicant: KYOCERA Document Solutions Inc., Osaka (JP)

(72) Inventor: Kohei Terasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/537,021

(22) Filed: Nov. 10, 2014

(65) Prior Publication Data

US 2015/0140488 A1 May 21, 2015

(30) Foreign Application Priority Data

Nov. 15, 2013 (JP) ..... 2013-237441

(51) Int. Cl.
*G03G 9/093* (2006.01)

(52) U.S. Cl.
CPC ..... *G03G 9/09328* (2013.01); *G03G 9/09371* (2013.01); *G03G 9/09392* (2013.01)

(58) Field of Classification Search
CPC ..... G03G 9/09307
See application file for complete search history.

(56) References Cited

U.S. PATENT DOCUMENTS 4,476,212 A * 10/1984 Kakimi ..... G03G 9/093 427/212
4,968,577 A * 11/1990 Kohri ..... G03G 9/0825 428/402.21
4,973,541 A * 11/1990 Kohri ..... G03G 9/093 428/402.21
5,225,308 A * 7/1993 Sasaki ..... G03G 9/09328 430/110.2
5,302,486 A * 4/1994 Patel ..... G03G 9/09321 430/110.2
2005/0271964 A1 12/2005 Etou et al.
2008/0057434 A1* 3/2008 Itoh ..... G03G 9/0806 430/137.15
2008/0241719 A1* 10/2008 Niwa ..... G03G 9/0819 430/48
2015/0099221 A1* 4/2015 Tsujihiro ..... G03G 9/093 430/108.4

FOREIGN PATENT DOCUMENTS

JP 2004-138985 A 5/2004
JP 2007-084603 A 4/2007

* cited by examiner

*Primary Examiner* — Hoa V Le
(74) *Attorney, Agent, or Firm* — Studebaker & Brackett PC

(57) ABSTRACT

An electrostatic charge image developing toner contains a plurality of toner particles. Each of the toner particles includes a toner core containing a binder resin and a shell layer coating the toner core. The shell layers contain a thermosetting resin. The toner cores have a negative zeta potential in an aqueous medium adjusted to pH 4. The toner particles have a positive zeta potential in an aqueous medium adjusted to pH 4. The shell layers have a film thickness of 1 nm or more and 20 nm or less.

5 Claims, 1 Drawing Sheet

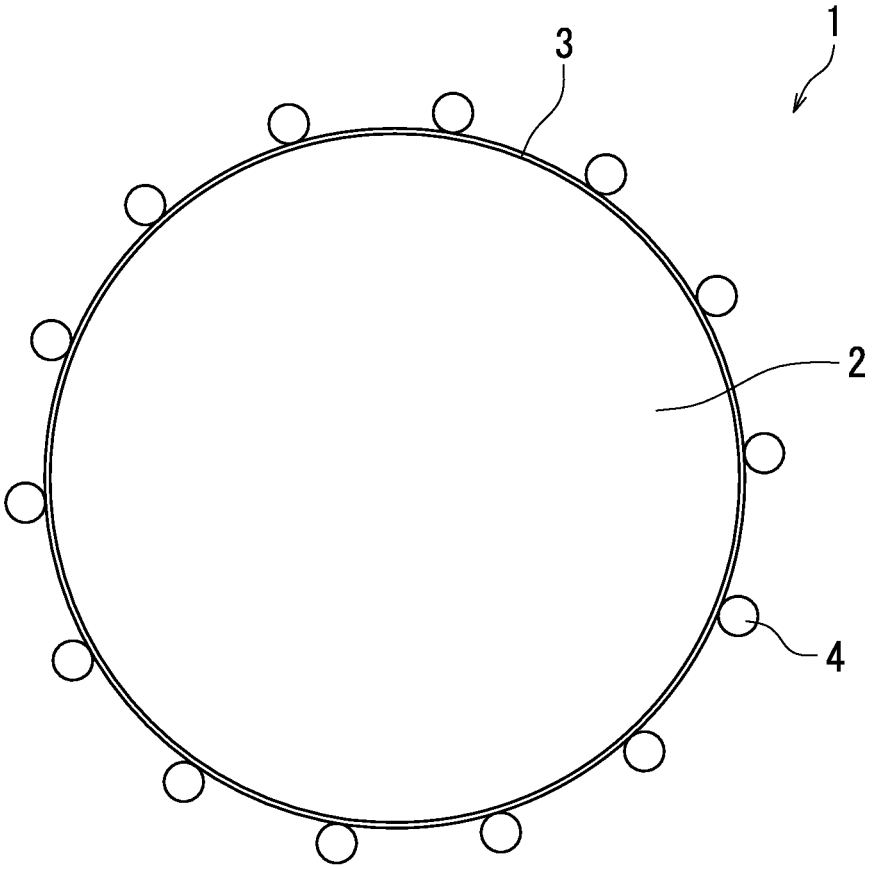
1
3
2
4

ELECTROSTATIC CHARGE IMAGE DEVELOPING TONER AND METHOD FOR PRODUCING ELECTROSTATIC CHARGE IMAGE DEVELOPING TONER

INCORPORATION BY REFERENCE

The present application claims priority under 35 U.S.C. §119 to Japanese Patent Application No. 2013-237441, filed Nov. 15, 2013. The contents of this application are incorporated herein by reference in their entirety.

BACKGROUND

The present disclosure relates to an electrostatic charge image developing toner and a method for producing an electrostatic charge image developing toner.

In the technical field of image formation by electrophotography, an electrostatic charge image developing toner is fixed to a recording medium such as paper by heat and pressure applied using a fixing roller. For saving energy for the fixing and downsizing apparatuses, an electrostatic charge image developing toner has been desired to have improved low-temperature fixability such as to be fixable at a temperature as low as possible. However, an electrostatic charge image developing toner having improved low-temperature fixability contains a binder resin having a low softening point (Tm) and a low glass transition point (Tg), and a releasing agent having a low softening point (Tm). Accordingly, toner particles contained in the electrostatic charge image developing toner tend to unfavorably aggregate when the electrostatic charge image developing toner is stored at high temperatures. An electrostatic charge image developing toner containing aggregated toner particles is more likely to have a reduced charge compared to an electrostatic charge image developing toner containing non-aggregated toner particles. The aggregated toner particles therefore tend to undesirably contribute to development. Consequently, a resulting image may have a defect.

In order to produce an electrostatic charge image developing toner having excellent low-temperature fixability, therefore, it has been desired to improve the preservability of toner at high temperatures and to reduce blocking of toner particles. To this end, a toner containing toner particles having a core-shell structure has been used. Toner particles of such an electrostatic charge image developing toner have a core-shell structure in which toner cores contain a binder resin having a low-melting point, and a surface of each toner core is coated with a shell layer containing a thermosetting resin. The shell layers have a higher glass transition point (Tg) than the binder resin contained in the toner cores.

As the electrostatic charge image developing toner having the core-shell structure, for example, an electrostatic charge image developing toner has been proposed in which the surface of each toner core has a shell layer containing a thermosetting resin. The toner cores have a softening point (Tm) of 40° C. or higher and 150° C. or lower.

In another example of the electrostatic charge image developing toner, a thermoplastic resin is used for the shell layers. Specifically, films of the shell layers are formed by melting the thermoplastic resin. In such an electrostatic charge image developing toner, the shell layer coating the surface of each toner core has a film thickness of 50 nm or more and 200 nm or less.

SUMMARY

An electrostatic charge image developing toner of the present disclosure contains a plurality of toner particles. Each of the toner particles includes a toner core containing a binder resin and a shell layer coating the toner core. The shell layers contain a thermosetting resin. The toner cores have a negative zeta potential in an aqueous medium adjusted to pH 4. The toner particles have a positive zeta potential in an aqueous medium adjusted to pH 4. The shell layers have a film thickness of 1 nm or more and 20 μm or less.

A method for producing an electrostatic charge image developing toner of the present disclosure is a method for producing an electrostatic charge image developing toner containing a plurality of toner particles. The method for producing an electrostatic charge image developing toner of the present disclosure includes forming toner cores containing a binder resin, and coating the toner cores with shell layers to form the toner particles. In the forming toner cores, the toner cores have a negative zeta potential in an aqueous medium adjusted to pH 4. In the coating with shell layers, the toner particles have a positive zeta potential in an aqueous medium adjusted to pH 4. The shell layers contain a thermosetting resin. The shell layers have a film thickness of 1 μm or more and 20 μm or less.

BRIEF DESCRIPTION OF THE DRAWINGS

FIG. 1 is a diagram illustrating a toner particle contained in an electrostatic charge image developing toner of an embodiment of the present disclosure.

DETAILED DESCRIPTION

Hereinafter, an embodiment of the present disclosure will be described in detail. The present disclosure is in no way limited to the following embodiment. Various alterations may be made within the scope of the object of the present disclosure to practice the present disclosure. It should be noted that explanation may be omitted where appropriate in order to avoid repetition, but such omission does not limit the gist of the present disclosure.

An electrostatic charge image developing toner of the embodiment of the present disclosure (hereinafter, may be referred to simply as "toner") contains a plurality of toner particles. Each of the toner particles includes at least a toner core containing a binder resin and a shell layer coating the toner core. The toner cores are anionic, and the shell layers are cationic.

Hereinafter, the electrostatic charge image developing toner will be described with reference to FIG. 1. FIG. 1 illustrates one of a plurality of toner particles 1 each including a toner core 2 and a shell layer 3. The toner cores 2 contain a binder resin. The shell layers 3 are formed (disposed) so as to coat (cover) the toner cores 2. The shell layers 3 contain a thermosetting resin.

(Binder Resin)

Hereinafter, components of the toner cores 2 will be described. The binder resin is an essential component of the toner cores 2. Preferably, the binder resin is anionic. Preferably, the binder resin has a functional group such as, for example, an ester group, a hydroxyl group, a carboxyl group, an amino group, an ether group, an acidic group, or a methyl group. Of the above-mentioned functional groups, it is more preferable that the binder resin has a hydroxyl group, a carboxyl group, or an amino group, and it is particularly preferable that the binder resin has a hydroxyl group and/or a carboxyl group. This is because these functional groups react with and become chemically bound to a unit derived from a monomer of the thermosetting resin (e.g., methylol melamine) included in the resin forming the shell layers. As a result, in the toner particles 1 including the toner cores 2 made from the binder resin having such a functional group, the toner cores 2 and the shell layers 3 are firmly bound to each other.

In the present disclosure, it is necessary to use an anionic binder resin so that the toner cores 2 are anionic. Accordingly, examples of the functional group of the binder resin include an ester group, a hydroxyl group, an ether group, an acidic group, and a methyl group. In this case, the binder resin is strongly anionic.

If the toner cores 2 of the present disclosure are not sufficiently anionic, a monomer or a prepolymer as a cationic shell layer material cannot be attracted to the surfaces of the toner cores 2.

When the binder resin has a carboxyl group, the binder resin preferably has an acid value of 3 mgKOH/g or more and 50 mgKOH/g or less, and more preferably 10 mgKOH/g or more and 40 mgKOH/g or less in order to be sufficiently anionic.

When the binder resin has a hydroxyl group, the binder resin preferably has a hydroxyl value of 10 mgKOH/g or more and 70 mgKOH/g or less, and more preferably 15 mgKOH/g or more and 50 mgKOH/g or less in order to be sufficiently anionic.

Preferably, the binder resin has a solubility parameter (SP value) of 10 or more. More preferably, the binder resin has a solubility parameter (SP value) of 15 or more. Having a solubility parameter (SP value) of 10 or more, which is close enough to a solubility parameter (SP value) of water of 23, the binder resin is more wettable with an aqueous medium. Accordingly, the binder resin has improved dispersibility in the aqueous medium without a dispersant. As a result, the later-described binder resin particle-containing dispersion can be homogeneous.

Examples of the binder resin include thermoplastic resins (e.g., styrene-based resins, acrylic-based resins, styrene-acrylic-based resins (e.g., styrene acrylate resin), polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, or styrene-butadiene-based resins). Of the above-mentioned thermoplastic resins, styrene-acrylic-based resins or polyester resins are preferable as the binder resin in terms of enhancing the dispersibility of a colorant in the toner cores 2, the chargeability of the toner particles 1, and the fix ability of the toner particles 1 to a recording medium.

A styrene-acrylic-based resin is a copolymer of a styrene-based monomer and an acrylic-based monomer. Examples of the styrene-based monomer include styrene, α-methylstyrene, p-hydroxystyrene, m-hydroxystyrene, vinyl toluene, α-chlorostyrene, o-chlorostyrene, m-chlorostyrene, p-chlorostyrene, and p-ethylstyrene.

Examples of the acrylic-based monomer include (meth) acrylic acid; (meth)acrylic acid alkyl esters (e.g., methyl (meth)acrylate, ethyl (meth)acrylate, n-propyl (meth)acrylate, iso-propyl (meth)acrylate, n-butyl (meth)acrylate, iso-butyl (meth)acrylate, or 2-ethylhexyl (meth)acrylate); and (meth)acrylic acid hydroxyalkyl esters (e.g., 2-hydroxyethyl (meth)acrylate, 3-hydroxypropyl (meth)acrylate, 2-hydroxypropyl (meth)acrylate, and 4-hydroxypropyl (meth) acrylate).

It should be noted that the term "(meth)acryl" is used as a generic term referring to both "acryl" and "methacryl".

Hydroxyl groups can be introduced into the styrene-acrylic-based resin by using a monomer having a hydroxyl group (e.g., p-hydroxystyrene, m-hydroxystyrene, hydroxyalkyl (meth)acrylate, or the like) in the preparation of the styrene-acrylic-based resin. The hydroxyl value of the styrene-acrylic-based resin can be adjusted by appropriately adjusting the amount of the monomer having a hydroxyl group.

Use of the (meth)acrylic acid as a monomer in the preparation of the styrene-acrylic-based resin allows introduction of carboxyl groups into the styrene-acrylic-based resin. The acid value of the styrene-acrylic-based resin can be adjusted by appropriately adjusting the amount of the (meth)acrylic acid.

A polyester resin is obtained by condensation polymerization or condensation copolymerization of a dihydric, or trihydric or higher-hydric alcohol component and a dibasic, or tribasic or higher-basic carboxylic acid component.

Examples of the dihydric, or trihydric or higher-hydric alcohol component include diols, bisphenols, and trihydric or higher-hydric alcohols. Examples of the diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol. Examples of the bisphenols include bisphenol A, hydrogenated bisphenol A, polyoxyethylenated bisphenol A, and polyoxypropylenated bisphenol A. Examples of the tri- or higher-hydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of the dibasic, or tribasic or higher-basic carboxylic acid component include dibasic, and tribasic or higher-basic carboxylic acid. Examples of the dibasic carboxylic acid include maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, and alkyl succinic acid and alkenyl succinic acid (e.g., n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, and isododecenyl succinic acid). Examples of the tribasic or higher-basic carboxylic acid include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl) methane, 1,2,7,8-octanetetracarboxylic acid, pyromellitic acid, and Empol trimer acid. These carboxylic acid components may be used in the form of an ester-forming derivative (e.g., an acid halide, an acid anhydride, or a lower alkyl ester). The term "lower alkyl" used herein refers to an alkyl group having 1 to 6 carbon atoms.

The acid value and the hydroxyl value of the polyester resin can be adjusted by appropriately changing the amount of the dihydric, or trihydric or higher-hydric alcohol component and the amount of the dibasic, or tribasic or higher-basic carboxylic acid component in the production of the polyester resin. The acid value and the hydroxyl value of the polyester resin tend to decrease with increase in the molecular weight of the polyester resin.

Preferably, the binder resin has a glass transition point (Tg) equal to or lower than the cure onset temperature of the thermosetting resin contained in the shell layers 3 in order to improve the low-temperature fixability. The glass transition point (Tg) of the binder resin in such a range enables the toner to show sufficient low-temperature fixability even in high-speed fixing. In particular, the binder resin preferably has a glass transition point (Tg) of 20° C. or higher, more preferably 30° C. or higher and 55° C. or lower, and still more preferably 30° C. or higher and 50° C. or lower. The glass transition point (Tg) of the binder resin of 20° C. or higher enables restriction of aggregation of the toner cores 2 in the formation of the shell layers 3.

The glass transition point (Tg) of the binder resin can be determined based on a point of change in the specific heat of the binder resin measured using a differential scanning calorimeter (DSC). For example, a heat absorption curve of the binder resin is obtained using the differential scanning calorimeter (e.g., "DSC-6220" manufactured by Seiko Instruments Inc.), and the glass transition point (Tg) is determined based on the heat absorption curve obtained. More specifically, 10 mg of a measurement sample is placed in an aluminum pan, and the heat absorption curve of the binder resin is obtained with an empty aluminum pan as a reference in a measurement temperature range of 25° C. to 200° C. at a heating rate of 10° C./minute. Then the glass transition point (Tg) is determined based on the heat absorption curve obtained.

The binder resin preferably has a softening point (Tm) of 100° C. or lower, and more preferably 95° C. or lower. The softening point (Tm) of the binder resin of 100° C. or lower enables the toner to show sufficient fixability even in high-speed fixing. The softening point (Tm) of the binder resin can be adjusted by combining a plurality of binder resins having different softening points (Tms), for example.

The softening point (Tm) of the binder resin can be measured using a capillary rheometer (e.g., "CFT-500D" manufactured by Shimadzu Corporation). Specifically, a measurement sample is set in the capillary rheometer, and the sample having a volume of 1 $cm^3$ is allowed to melt-flow under a specified condition (die pore size: 1 mm, plunger load: 20 $kg/cm^2$, heating rate: 6° C./minute). Thus, an S-shaped curve (i.e., an S-shaped curve relating temperature (° C.) to stroke (mm)) is obtained, and the softening point (Tm) of the binder resin is read from the S-shaped curve.

When the binder resin is a polyester resin, the polyester resin preferably has a number average molecular weight (Mn) of 1200 or more and 2000 or less for enhancing the strength of the toner cores 2 and the fixability of the toner. For the same reason, the polyester resin preferably has a molecular weight distribution (mass average molecular weight Mw/number average molecular weight Mn: ratio of weight average molecular weight Mw to number average molecular weight Mn) of 9 or more and 20 or less.

When the binder resin is a styrene-acrylic-based resin, the styrene-acrylic-based resin preferably has a number average molecular weight (Mn) of 2000 or more and 3000 or less for enhancing the strength of the toner cores 2 and the fixability of the toner. For the same reason, the styrene-acrylic-based resin preferably has a molecular weight distribution of 10 or more and 20 or less. The number average molecular weight (Mn) and the mass average molecular weight (Mw) of the binder resin can be measured by gel permeation chromatography.

(Colorant)

As the colorant, a known pigment or dye may be used depending on the color of the toner particles 1. Carbon black may be used as a black colorant. Alternatively, a colorant adjusted to a black color using colorants described below, such as a yellow colorant, a magenta colorant, and a cyan colorant, can be used as the black colorant.

When the toner containing the toner particles 1 is a color toner, the toner cores 2 of the toner particles 1 may contain a colorant such as a yellow colorant, a magenta colorant, and a cyan colorant.

Examples of the yellow colorant include a condensed azo compound, an isoindolinone compound, an anthraquinone compound, an azo metal complex, a methine compound, and an allylamide compound. Specific examples thereof include C.I. pigment yellows (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa yellow G, and C.I. Vat yellow.

Examples of the magenta colorant include a condensed azo compound, a diketopyrrolopyrrole compound, an anthraquinone compound, a quinacridone compound, a basic dye lake compound, a naphthol compound, a benzimidazolone compound, a thioindigo compound, and a perylene compound. Specific examples thereof include C.I. pigment reds (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of the cyan colorant include a copper phthalocyanine compound, a copper phthalocyanine derivative, an anthraquinone compound, and a basic dye lake compound. Specific examples thereof include C.I. pigment blues (1, 7, 15, 15:1, 15:2, 15:3, 15:4, 60, 62, and 66), phthalocyanine blue, C.I. Vat blue, and C.I. acid blue.

The amount of the colorant is preferably 1 part by mass or more and 20 parts by mass or less, and more preferably 3 parts by mass or more and 10 parts by mass or less relative to 100 parts by mass of the binder resin.

(Releasing Agent)

The releasing agent is used for the purpose of enhancing the low-temperature fixability and the hot offset resistance of the electrostatic charge image developing toner. Examples of the releasing agent include: aliphatic hydrocarbon-based waxes (e.g., ester-based waxes, polyethylene waxes (specifically, low molecular weight polyethylene), polypropylene waxes (specifically, low molecular weight polypropylene), polyolefin copolymer, polyolefin wax, microcrystalline wax, paraffin wax, and Fischer-Tropsch wax); oxides of the aliphatic hydrocarbon-based waxes (e.g., oxidized polyethylene wax, and block copolymers of oxidized polyethylene wax); plant waxes (e.g., candelilla wax, carnauba wax, Japan wax, jojoba wax, and rice wax); animal waxes (e.g., beeswax, lanolin, and spermaceti); mineral waxes (e.g., ozokerite, ceresin, and petrolatum); waxes containing a fatty acid ester as a major component (e.g., montanic acid ester wax, and castor wax); and waxes containing partially or fully deoxidized fatty acid ester (e.g., deoxidized carnauba wax). In particular, an anionic wax is preferably used. Examples of the anionic wax include esters wax, carnauba wax, polyethylene wax, polypropylene wax, and Fischer-Tropsch wax.

For enhancing the low-temperature fixability and the hot offset resistance, the amount of the releasing agent is preferably 1 part by mass or more and 30 parts by mass or less, and more preferably 5 parts by mass or more and 20 parts by mass or less relative to 100 parts by mass of the binder resin.

(Charge Control Agent)

Hereinafter, a charge control agent contained in the toner cores 2 will be described. Since the toner cores 2 are anionic in the present embodiment, a negative charge control agent is usable for the toner cores 2. A charge control agent is used to improve charge stability or a charge rise characteristic with the aim of providing the toner with excellent durability or excellent stability. The charge rise characteristic is an indication of whether or not the toner particles 1 can be charged to a predetermined charge level within a short period of time.

The toner cores 2 may contain a magnetic powder as needed. An electrostatic charge image developing toner containing the toner particles 1 prepared using the toner cores 2 containing a magnetic powder is used as a one-component magnetic developer. Examples of the magnetic powder include: iron (ferrite and magnetite), ferromagnetic metals (cobalt and nickel), alloys containing iron and/or ferromagnetic metal, compounds containing iron and/or ferromagnetic metal, ferromagnetic alloys subjected to ferromagnetization such as thermal treatment, and chromium dioxide.

The magnetic powder preferably has a particle diameter of 0.1 μm or more and 1.0 μm or less, and more preferably 0.1 μm or more and 0.5 μm or less. A magnetic powder having a particle diameter falling within the range described above can readily be dispersed homogeneously in the binder resin.

When the electrostatic charge image developing toner is used in the form of a one-component developer, the amount of the magnetic powder is preferably 35 parts by mass or more and 60 parts by mass or less, and more preferably 40 parts by mass or more and 60 parts by mass or less relative to 100 parts by mass of the toner.

In the present embodiment, a zeta potential of the toner cores 2 (toner cores 2 before being coated with the shell layers 3 or toner cores 2 obtained by removing the shell layers 3 from the toner particles 1) being negative (specifically, lower than 0 mV) as measured in an aqueous medium adjusted to pH 4 is an indication of the toner cores 2 being anionic. In order for the toner cores 2 to be favorably anionic, the zeta potential is preferably −5 mV or lower and more preferably −10 mV or lower.

(Method for Measuring Zeta Potential)

Examples of a method for measuring the zeta potential include an electrophoresis method, an ultrasound method, and an electroacoustic sonic amplitude (ESA) method. The electrophoresis method involves applying an electric field to a dispersion of the toner cores 2 to electrophorese charged particles in the dispersion, measuring the electrophoretic velocity, and calculating the zeta potential based on the electrophoretic velocity. Examples of the electrophoresis method include the laser Doppler method. The laser Doppler method involves irradiating the toner cores 2 being electrophoresed with laser light and determining the electrophoretic velocity based on the Doppler shift of scattered light obtained. The laser Doppler method is advantageous in that the concentration of the toner cores 2 in the dispersion need not be high, that fewer parameters are needed for calculating the zeta potential, and that the electrophoretic velocity can be sensitively detected.

The ultrasound method involves applying an ultrasound wave to a dispersion of the toner cores 2 to oscillate charged particles in the dispersion and calculating the zeta potential based on a potential difference that arises because of the oscillation. The ESA method involves applying a high-frequency voltage to a dispersion of the toner cores 2 to oscillate charged particles in the dispersion, thereby generating an ultrasound wave, detecting the magnitude (strength) of the ultrasound wave, and calculating the zeta potential based on the magnitude (strength) of the ultrasound wave. The ultrasound method and the ESA method are advantageous in that the zeta potential can be sensitively measured even if the dispersion of the toner cores 2 has an excessively high toner core 2 concentration (e.g., higher than 20% by mass).

Another indication of the toner cores 2 being anionic is a magnitude of its triboelectric charge value being negative (specifically, smaller than 0 μC/g) as determined with a standard carrier. Preferably, the triboelectric charge value determined with a standard carrier is −10 μC/g or smaller. The triboelectric charge value is an indication of whether the toner cores 2 is positively charged or negatively charged. The triboelectric charge value is also an indication of the chargeability of the toner cores 2. How to determine the triboelectric charge value of the toner cores 2 with the standard carrier will be described later.

If the toner cores 2 have a glass transition point (Tg) of higher than 55° C., it is impossible to obtain sufficient fixing strength in a high-speed fixing system. Accordingly, the toner cores 2 preferably have a glass transition point (Tg) of 20° C. or higher and 60° C. or lower, and more preferably 25° C. or higher and 55° C. or lower. The glass transition point (Tg) of the toner cores 2 can be measured using a measurement sample of the toner cores 2 by the same method as in the measurement of the glass transition point (Tg) of the binder resin described above.

(Resin Forming Shell Layers 3)

The resin forming the shell layers 3 includes a thermosetting resin so that the shell layers 3 are sufficiently cationic and the shell layers 3 can have enhanced strength. The thermosetting resin has a unit obtained by introducing a methylene group ($-CH_2-$) derived from formaldehyde into a monomer such as melamine, for example.

Examples of the thermosetting resin include melamine resins, guanamine resins, sulfonamide resins, urea resins, glyoxal resins, aniline resins, and polyimide resins. In particular, the thermosetting resin is preferably one or more resins selected from the group of amino resins consisting of a melamine resin, a urea resin, and a glyoxal resin. More preferably, the thermosetting resin is a melamine resin or a urea resin.

Preferably, the thermosetting resin is cationic. Examples of the cationic thermosetting resin include thermosetting resins having amino groups ($—NH_2$), which are collectively termed amino resins, and thermosetting resins having nitrogen atoms in the polymer backbone. Examples of the thermosetting resin having amino groups include a melamine resin and derivatives thereof; a guanamine resin and derivatives thereof; a sulfonamide resin; a urea resin and derivatives thereof; a glyoxal resin; and an aniline resin. Examples of the thermosetting resin having nitrogen atoms in the polymer backbone include thermosetting polyimide resins; and maleimide-based polymers (specifically, bismaleimide polymers, aminobismaleimide polymers, and bismaleimide-triazine copolymers).

The melamine resin is a polycondensate of melamine and formaldehyde. That is, melamine is a monomer used to form the melamine resin. The urea resin is a polycondensate of urea and formaldehyde. That is, urea is a monomer used to form the urea resin. The glyoxal resin is a polycondensate of formaldehyde and a reaction product of glyoxal and urea. That is, a reaction product of glyoxal and urea is a monomer used to form the glyoxal resin. The melamine or the urea may be modified in a known manner. For example, methylol melamine obtained by methylolating melamine may be used as a monomer to form the melamine resin. When the resin forming the shell layers 3 includes a thermoplastic resin, the thermosetting resin may include a derivative methylolated with formaldehyde before the reaction with the thermoplastic resin.

Examples of a monomer of the guanamine resin include benzoguanamine, acetoguanamine, and spiroguanamine.

Preferably, the shell layers 3 contain nitrogen atoms derived from melamine or urea. Nitrogen-containing materials tend to be positively charged. It is therefore easy to positively charge the toner particles 1 including the shell layers 3 formed from a nitrogen-containing material to a desired charge amount. Accordingly, the shell layers 3 preferably have a nitrogen atom content of 10% by mass or more relative to the total mass of the shell layers.

The shell layers 3 may contain a thermoplastic resin. The thermoplastic resin may be cross-linked with the monomer of the thermosetting resin. With such a structure, the shell layers 3 can have suitable flexibility resulting from the thermoplastic resin and suitable mechanical strength resulting from a three-dimensional cross-linking structure formed by the monomer of the thermosetting resin. Thus, the shell layers 3 are not easily broken during storage at high temperatures and during transport. However, the shell layers 3 are easily broken when subjected to pressure during low-temperature fixing. As a result, softening of the binder resin contained in the toner cores 2 and melting of the toner cores 2 progress smoothly. Thus, the toner can be favorably fixed to a recording medium such as paper in a low temperature range (at a lower temperature). That is, the toner can have excellent high-temperature preservability (blocking resistance) and low-temperature fixability.

When the shell layers 3 contain a thermoplastic resin, the thermoplastic resin preferably has a functional group reactive with the functional group, such as a methylol group or an amino group, of the thermosetting resin described above. Examples of the functional group reactive with the functional group of the thermosetting resin include a functional group containing an active hydrogen atom (e.g., hydroxyl group, carboxyl group, and amino group). The amino group may be contained in the thermoplastic resin in the form of a carbamoyl group (—$CONH_2$). In terms of allowing simple formation of the shell layers 3, the thermoplastic resin is preferably a resin containing a unit derived from (meth) acrylamide or a resin containing a unit derived from a monomer having such a functional group as a carbodiimide group, an oxazoline group, or a glycidyl group.

Examples of the thermoplastic resin to be used for forming the shell layers 3 include (meth)acrylic-based resins, styrene-(meth)acrylic-based copolymer, silicone-(meth) acrylic graft copolymers, polyurethane resins, polyester resins, polyvinyl alcohols, and ethylene vinyl alcohol copolymers. The thermoplastic resin may contain a unit derived from a monomer having a functional group such as a carbodiimide group, an oxazoline group, or a glycidyl group. Of these thermoplastic resins, (meth)acrylic-based resins, styrene-(meth)acrylic-based copolymer, and silicone-(meth)acrylic graft copolymers are preferable, and (meth) acrylic-based resins are more preferable.

Examples of a (meth)acrylic-based monomer usable for preparing the (meth)acrylic-based resin include (meth) acrylic acid; (meth)acrylic acid alkyl esters (e.g., methyl (meth)acrylate, ethyl (meth)acrylate, n-propyl (meth)acrylate, and n-butyl (meth)acrylate); (meth)acrylic acid aryl esters (e.g., phenyl (meth)acrylate); (meth)acrylic acid hydroxyalkyl esters (e.g., 2-hydroxyethyl (meth)acrylate, 3-hydroxypropyl (meth)acrylate, 2-hydroxypropyl (meth) acrylate, and 4-hydroxybutyl (meth)acrylate); (meth)acrylamide; an ethylene oxide adduct of (meth)acrylic acid; alkyl ether (e.g., methyl ether, ethyl ether, n-propyl ether, or n-butyl ether) of an ethylene oxide adduct of (meth)acrylic ester.

Preferably, the shell layers 3 are formed in an aqueous medium. An aqueous medium allows the binder resin to well dissolve therein and reduces the possibility of elution of the optional releasing agent. When the shell layers 3 contain a thermoplastic resin, therefore, the thermoplastic resin preferably is water-soluble.

When the shell layers 3 contain a thermoplastic resin, a ratio (Ws/Wp) of the thermosetting resin content (Ws) to the thermoplastic resin content (Wp) in the shell layers 3 is preferably 3/7 or more and 8/2 or less, and more preferably 4/6 or more and 7/3 or less in terms of enhancing the high-temperature preservability and the low-temperature fixability.

In the present embodiment, a zeta potential of the toner particles 1 (specifically, the shell layers 3 formed as surfaces of the toner particles 1) being positive (specifically, higher than 0 mV) as measured in an aqueous medium adjusted to pH 4 is an indication of the shell layers 3 being cationic. The zeta potential is preferably 0 mV or higher and 60 mV or lower, and more preferably 30 mV or higher and 40 mV or lower in order that the toner particles 1 are favorably cationic.

(Method for Measuring Zeta Potential)

The zeta potential of the toner particles 1 can be measured by the same method as in the measurement of the zeta potential of the toner cores 2 described above, for example.

Another indication of the shell layers 3 being cationic is a magnitude of their triboelectric charge value of 0 μC/g or larger as determined with a standard carrier. The triboelectric charge value is an indication of whether the toner particles 1 (specifically, the shell layers 3 formed as the surfaces of the toner particles 1) is positively charged or negatively charged. The triboelectric charge value is also an indication of the chargeability of the toner particles 1. How to determine the triboelectric charge value of the toner core 1 with the standard carrier will be described later.

The shell layers 3 preferably have a film thickness of 1 nm or more and 20 nm or less, and more preferably 4 nm or more and 10 nm or less, for example. Having a film thickness of 20 nm or less, the shell layers 3 are easily broken by heat and pressure applied when the toner is fixed to a recording medium such as paper. As a result, softening and melting of the binder resin contained in the toner cores 2 progress smoothly, allowing the toner to be fixed to the recording medium at low temperatures. Furthermore, the shell layers 3 are prevented from having too high chargeability, allowing appropriate image formation. Having a film thickness of 1 nm or more, the shell layers 3 can have sufficient strength. As a result, the possibility that the shell layers 3 are broken on impact or the like during transport can be reduced. When the toner particles 1 including the shell layers 3 at least partially broken are stored in a high-temperature condition, a component of the toner cores 2 such as the releasing agent easily exudates to the surfaces of the toner particles 1 through the broken portions of the shell layers 3. In such a case, the toner particles tend to aggregate. Having a film thickness of 1 nm or more, the shell layers 3 can be prevented from having too low chargeability. Thus, the possibility of the occurrence of a defect in an image to be formed can be reduced.

The thickness of one shell layer 3 can be measured by analyzing a TEM image of a cross-section of one toner particle 1 using commercially available image analysis software (e.g., "WinROOF", product by Mitani Corporation). Specifically, on the cross-section of one toner particle 1, two straight lines are drawn to intersect at right angles at approximately the center of the cross-section. Lengths of segments of the two lines crossing the shell layer 3 are measured at four locations. An average value of the lengths measured at the four locations is determined to be a thickness of the one shell layer 3 of the one toner particle 1 measured. The same measurement of the thickness of the shell layer 3 is performed on ten or more toner particles 1 to obtain the thicknesses of the shell layers 3 of the respective toner particles 1. An average value of the thicknesses of the shell layers 3 thus obtained is determined to be the thickness of the shell layers 3.

When a shell layer 3 has a small thickness, the TEM image may not clearly show the boundary between the shell layer 3 and the toner core 2, making it difficult to measure the thickness of the shell layer 3. In this case, a combination of TEM imaging and electron energy loss spectroscopy (TEM-EELS) may be employed to clarify the boundary between the shell layer 3 and the toner core 2, and thus the thickness of the shell layer 3 can be measured. For example, when it is difficult to measure the thickness of the shell layer 3 using a TEM image, the TEM-EELS may be applied to the TEM image to perform mapping of an element, such as nitrogen, specific to the material of the shell layer 3, and thus the thickness of the shell layer 3 can be measured.

Each toner particle 1 may have a structure including a plurality of shell layers 3 on the surface of the toner core 2. In this case, at least the outermost shell layer 3 of the toner particle 1 needs to be cationic. When a cationic shell layer 3 is formed on the surface of the anionic toner core 2, and then a shell layer as the second layer is formed thereon, the functionality of the toner is further improved.

(Charge Control Agent)

Hereinafter, a charge control agent that may be contained as needed in the shell layers 3 will be described. Since the shell layers 3 are cationic in the present embodiment, a positive charge control agent is usable for the shell layers 3.

Preferably, the pH where the zeta potential measured in the aqueous medium used for the formation of the toner particles 1 (specifically, the dispersion of the toner cores 2 used for the formation of the shell layers 3 on the surfaces of the toner cores 2) is zero is 4.5 or higher and 7.0 or lower. More preferably, the pH where the zeta potential is zero is 5.0 or higher and 6.5 or lower. As long as this pH is 4.5 or higher, the shell layers 3 can have a uniform thickness. Consequently, the reduction of the blocking resistance can be prevented even when the toner is stored at high temperatures. That is, the toner particles 1 have excellent high-temperature preservability (blocking resistance). As long as this pH is 7.0 or lower, the shell layers 3 are prevented from having too large thickness. Consequently, the shell layers 3 can be easily broken by heat and pressure applied during the fixing. That is, the toner particles 1 have extremely excellent low-temperature fixability. The pH where the zeta potential measured in an aqueous medium is zero may be referred to as "isoelectric point".

The toner particles 1 preferably have a volume median diameter ($D_{50}$) of 3.0 nm or more and 10.0 μm or less, and more preferably 4.0 μm or more and 9.0 μm or less.

(External Additive)

The toner particles 1 may contain an external additive 4. The amount of the external additive 4 is preferably 1 part by mass or more and 10 parts by mass or less, and more preferably 2 parts by mass or more and 5 parts by mass or less relative to 100 parts by mass of the toner mother particles in terms of enhancing the fluidity and the handling characteristics. The toner particles 1 yet to be treated with the external additive 4 may be referred to as "toner mother particle".

(Carrier)

The toner particles 1 may be mixed with a desired carrier to be used in the form of a two-component developer. Preferably, the carrier is a magnetic carrier. Examples of the magnetic carrier include a magnetic carrier whose particles each have a resin-coated carrier core. Examples of the carrier cores include: particles of iron, oxidized iron, reduced iron, magnetite, copper, silicon steel, ferrite, nickel, or cobalt; particles of alloys of one or more of the above-mentioned materials and a metal such as manganese, zinc, or aluminum; particles of iron-nickel alloys or iron-cobalt alloys; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; and particles of high-dielectric substances, such as ammonium dihydrogen phosphate, potassium dihydrogen phosphate, or Rochelle salt. The magnetic carrier may be a resin carrier obtained by dispersing any of the above-mentioned magnetic particles in a resin.

Examples of the resin for coating the carrier core include (meth)acrylic-based polymers, styrene-based polymers, styrene-(meth)acrylic-based copolymers, olefin-based polymers (polyethylene, chlorinated polyethylene, and polypropylene), polyvinyl chlorides, polyvinyl acetates, polycarbonate resins, cellulose resins, polyester resins, unsaturated polyester resins, polyamide resins, polyurethane resins, epoxy resins, silicone resins, fluororesins (e.g., polytetrafluoroethylene, polychlorotrifluoroethylene, and polyvinylidene fluoride), phenolic resins, xylene resins, diallylphthalate resins, polyacetal resins, and amino resins. These resins may be used independently, or two or more of the resins may be used in combination.

The carrier preferably has a particle diameter of 20 μm or more and 120 μm or less, and more preferably 25 μm or more and 80 μm or less. The particle diameter of the carrier can be measured using an electron microscope.

When the toner is used in a two-component developer, the toner content is preferably 3% by mass or more and 20% by mass or less, and more preferably 5% by mass or more and 15% by mass or less relative to the mass of the two-component developer.

<<Method for Producing Electrostatic Charge Image Developing Toner>>

Hereinafter, a method for producing an electrostatic charge image developing toner according to an embodiment of the present disclosure will be described. The method for producing an electrostatic charge image developing toner of the present embodiment produces an electrostatic charge image developing toner containing a plurality of toner particles. The production method of the present embodiment includes: forming the toner cores 2 containing a binder resin (toner core formation process); and coating the toner cores 2 with the shell layers 3 to form the toner particles 1 (shell layer formation process). Through the toner core formation process and the shell layer formation process, the toner particles 1 each including the toner core 2 and the shell layer 3 coating the toner core 2 can be produced.

<<Toner Core Formation Process>>

In the toner core formation process, a method that allows optional components other than the binder resin (e.g., colorant, charge control agent, releasing agent, or magnetic powder) to be well dispersed in the binder resin is employed. Specific examples of the method include a melt-kneading method and an aggregation method.

The toner core formation process by the melt-kneading method includes a mixing process, a melt-kneading process, a pulverization process, and a classification process. In the mixing process, the binder resin and the other optional components are mixed to give a mixture. In the melt-kneading process, the mixture is melt-kneaded to give a melt-kneaded product. In the pulverization process, the melt-kneaded product is cooled and solidified as appropriate, and then pulverized by a known method to give a pulverized product. In the classification process, the pulverized product is classified by a known method to give the toner cores 2 having a desired particle diameter.

The toner cores 2 can be prepared more easily by the melt-knead method than by the later-described aggregation method. However, it is difficult to obtain the toner cores 2 with high sphericity by the melt-kneading method because the method includes the pulverization process. The disadvantage of the melt-kneading method of giving the toner cores 2 with somewhat lower sphericity can be avoided because the toner cores 2 soften and contract due to their own surface tension while the curing reaction of the thermosetting resin contained in the shell layers 3 progresses in the later-described shell layer formation process, and thus the toner cores 2 can be spheronized.

The toner core formation process by the aggregation method includes an aggregation process and a coalescing process. When the toner cores 2 are prepared by the aggregation method, the toner particles 1 can have a uniform shape and a uniform particle diameter.

In the aggregation process, fine particles containing components for forming the toner cores 2 are aggregated in an aqueous medium to form aggregated particles. In the coalescing process, the components contained in the aggregated particles obtained in the aggregation process are coalesced in an aqueous medium to give the toner cores 2.

In the aggregation process, fine particles containing components for forming the toner cores 2 are prepared. The fine particles containing the components for forming the toner cores 2 may be fine particles containing a binder resin and other optional components (a colorant, a releasing agent, or a charge control agent).

Typically, the fine particles containing the components for forming the toner cores 2 are prepared as an aqueous dispersion (binder resin fine particle dispersion) containing fine particles of a binder resin (binder resin fine particles) by micronizing the binder resin or a binder resin-containing composition into fine particles having a desired size in an aqueous medium. The binder resin fine particle dispersion may include an aqueous dispersion of fine particles of a component other than the binder resin (e.g., a colorant fine particle dispersion or a release agent fine particle dispersion). In the aggregation process, the fine particles in the binder resin fine particle dispersion are aggregated to give aggregated particles.

In the toner core formation process, the zeta potential of the toner cores 2 measured in an aqueous medium adjusted to pH 4 is negative (specifically, lower than 0 mV). The zeta potential is preferably −5 mV or lower, and more preferably −10 mV or lower in order that the toner cores 2 are favorably anionic. The zeta potential of the toner cores 2 can be measured by the same method as the method for measuring zeta potential described above.

Hereinafter, a method for preparing the binder resin fine particle dispersion (preparation method 1), a method for preparing the releasing agent fine particle dispersion (preparation method 2), and a method for preparing the colorant fine particle dispersion (preparation method 3) will be described. Fine particles containing a component other than the binder resin, the colorant, and the releasing agent can be prepared by appropriately selecting steps in the preparation methods 1 to 3.

(Preparation Method 1)

In the preparation method 1, the binder resin is coarsely pulverized using a pulverizer (e.g., Turbo Mill). The resulting coarsely pulverized product is dispersed in an aqueous medium such as ion exchanged water, heated, and then subjected to a strong shear force using a high-speed shear emulsification device (e.g., "CLEARMIX", manufactured by M Technique Co., Ltd.) to give a dispersion of binder resin fine particles. Preferably, the heating temperature is at least 10° C. higher than the softening point (Tm) of the binder resin (approximately 200° C. at the highest).

The binder resin fine particles preferably have a volume median diameter ($D_{50}$) of 1 μm or less, and more preferably 0.05 μm or more and 0.5 μm or less. The volume median diameter ($D_{50}$) of the binder resin fine particles within the above-mentioned range ensures that the toner cores 2 having a sharp particle size distribution and a uniform shape can be prepared. The volume median diameter ($D_{50}$) of the binder resin fine particles can be measured using a laser diffraction particle size distribution measuring device (e.g., "SALD-2200" manufactured by Shimadzu Corporation), for example.

The dispersion containing the binder resin fine particles may include a surfactant. Use of a surfactant enables the binder resin fine particles to be dispersed in the aqueous medium in a stable manner.

A resin having an acidic group may be used as the binder resin. In this case, the specific surface area of the binder resin increases if the binder resin is micronized in an aqueous medium as is. Affected by acidic groups exposed to surfaces of the fine particles including the binder resin, the pH of the aqueous medium may decrease to approximately 3-4. If the pH of the aqueous medium decreases to approximately 3-4, the binder resin may be hydrolyzed or the binder resin may not be effectively micronized to fine particles having a desired particle diameter.

In order to avoid such problems, a basic substance may be added to the aqueous medium in the preparation method 1. Any basic substance may be used as long as it can restrict the problems. Examples of the basic substance include alkali metal hydroxides (e.g., sodium hydroxide, potassium hydroxide, and lithium hydroxide), alkali metal carbonates (e.g., sodium carbonate and potassium carbonate), alkali metal hydrogencarbonates (e.g., sodium hydrogencarbonate and potassium hydrogencarbonate), and nitrogen-containing organic bases (N,N-dimethylethanolamine, N,N-diethylethanolamine, triethanolamine, tripropanolamine, tributhanolamine, triethylamine, n-propylamine, n-butylamine, isopropylamine, monomethanolamine, morpholine, methoxypropylamine, pyridine, and vinylpyridine).

(Surfactant)

Examples of the surfactant include anionic surfactants, cationic surfactants, and nonionic surfactants. Examples of the anionic surfactants include sulfate surfactants, sulfonate surfactants, phosphate surfactants, and soaps. Examples of the cationic surfactants include amine salt surfactants and quaternary ammonium salt surfactants. Examples of the nonionic surfactants include polyethylene glycol surfactants, alkylphenol ethylene oxide adduct surfactants, and polyhydric alcohol surfactants (e.g., derivatives of polyhydric alcohol such as glycerin, sorbitol, or sorbitan). Of these surfactants, anionic surfactants are preferable. The surfactants may be used independently, or two or more of the surfactants may be used in combination.

Preferably, the amount of the surfactant is 0.01% by mass or more and 10% by mass or less relative to the mass of the binder resin in terms of enhancing the dispersibility of the fine particles.

(Preparation Method 2)

In the preparation method 2, the releasing agent is coarsely pulverized in advance into particles having a diameter of approximately 100 μm or less to give a releasing agent powder. The releasing agent powder is added to an aqueous medium to give a slurry. The aqueous medium preliminarily contains a surfactant. Preferably, the amount of the surfactant is 0.01% by mass or more and 10% by mass or less relative to the mass of the releasing agent in terms of enhancing the dispersibility of the fine particles.

Next, the resulting slurry is heated to a temperature equal to or higher than the melting point of the releasing agent. The heated slurry is subjected to a strong shear force using a homogenizer ("ULTRA-TURRAX T50" manufactured by IKA Works), a pressure discharge disperser, or the like to give an aqueous dispersion containing releasing agent fine particles (releasing agent fine particle dispersion). Examples of the devices for applying a strong shear force to the dispersion include NANO3000 (Beryu Co.), Nanomizer (YOSHIDA KIKAI CO., LTD.), Microfluidizer (MFI Corporation), Gaulin Homogenizer (Manton Gaulin), and CLEARMIX W-MOTION (M Technique Co., Ltd.)

The volume median diameter ($D_{50}$) of the releasing agent fine particles contained in the releasing agent fine particle dispersion is preferably 1 μm or less, and more preferably 0.1 μm or more and 0.7 μm or less, and particularly preferably 0.28 μm or more and 0.55 μm or less. Having a volume median diameter ($D_{50}$) within the above-mentioned range, the releasing agent fine particles can be homogeneously dispersed in the binder resin more easily. The volume median diameter ($D_{50}$) of the releasing agent fine particles can be measured by the same method as in the measurement of the volume median diameter ($D_{50}$) of the binder resin fine particles.

(Preparation Method 3)

In the preparation method 3, a colorant and, as needed, a dispersant for the colorant are dispersed in an aqueous medium containing a surfactant using a known disperser. Thus, an aqueous dispersion containing colorant fine particles (colorant fine particle dispersion) can be prepared. The surfactant may be the same as the surfactant used for the preparation of the binder resin fine particles. The amount of the surfactant is preferably 0.01 parts by mass or more and 10 parts by mass or less relative to 100 parts by mass of the colorant in terms of enhancing the dispersibility of the fine particles including the colorant.

Examples of the disperser usable for the dispersing include a pressure disperser and a medium disperser. Examples of the pressure disperser include an ultrasonic disperser, a mechanical homogenizer, Manton-Gaulin, a pressure homogenizer, and a high-pressure homogenizer (YOSHIDA KIKAI CO., LTD.) Examples of the medium disperser include a sand grinder, a horizontal or vertical bead mill, Ultra Apex Mill (Kotobuki Industrial Co., Ltd.), Dyno Mill (WAB AG), and MSC Mill (Nippon Coke & Engineering Co., Ltd.)

The volume median diameter ($D_{50}$) of the colorant fine particles is preferably 0.01 μm or more and 0.2 μm or less. The volume median diameter ($D_{50}$) of the colorant fine particles can be measured by the same method as in the measurement of the volume median diameter ($D_{50}$) of the binder resin fine particles.

The binder resin fine particle dispersion is appropriately mixed with the releasing agent fine particle dispersion and/or the colorant fine particle dispersion as needed so that the toner cores 2 contain predetermined components. Next, the fine particles are aggregated in the dispersion mixture to give an aqueous dispersion of aggregated particles containing the binder resin.

(Aggregation Process)

In the aggregation process, the fine particles can be aggregated as follows. First, the pH of the aqueous dispersion containing the binder resin fine particles is adjusted, and then a coagulant is added to the aqueous dispersion. Next, the temperature of the aqueous dispersion is adjusted to a predetermined temperature to aggregate the fine particles.

(Coagulant)

Examples of the coagulant include inorganic metal salts, inorganic ammonium salts, and divalent or polyvalent metal complexes. Examples of the inorganic metal salts include metal salts (sodium sulfate, sodium chloride, calcium chloride, calcium nitrate, barium chloride, magnesium chloride, zinc chloride, aluminum chloride, and aluminum sulfate), and inorganic metal salt polymers (polyaluminum chloride and polyaluminum hydroxide). Examples of the inorganic ammonium salts include ammonium sulfate, ammonium chloride, and ammonium nitrate. Cationic surfactants of a quaternary ammonium salt type and nitrogen-containing compounds (e.g., polyethylenimine) may also be used as the coagulant.

As the coagulant, a divalent metal salt and a monovalent metal salt may be used. The coagulants may be used independently, or two or more of the coagulants may be used in combination. When two or more of the coagulants are used in combination, it is preferable to use a divalent metal salt and a monovalent metal salt in combination. This is because the aggregation rate of fine particles of the divalent metal salt and the aggregation rate of fine particles of the monovalent metal salt are different, and therefore the particle diameter of aggregated particles to be obtained can be controlled by using the divalent metal salt and the monovalent metal salt in combination. Furthermore, the use of the divalent metal salt and the monovalent metal salt in combination allows the aggregated particles to have sharp particle size distribution. In the aggregation process, the aqueous dispersion before the coagulant is added is preferably alkalified to a pH of 8 or higher. The coagulant may be added all at once or in parts.

Preferably, the amount of the coagulant is 1 part by mass or more and 50 parts by mass or less relative to 100 parts by mass of the solid content in the aqueous dispersion in terms of effectively advancing the aggregation of the fine particles. The amount of the coagulant can be adjusted as appropriate depending on the type and the amount of the dispersant contained in the fine particle dispersion.

In the aggregation process, the temperature of the aqueous dispersion when the fine particles are aggregated is preferably equal to or higher than the glass transition point (Tg) of the binder resin and lower than (glass transition point (Tg) of binder resin +10° C.)° C. When the aqueous dispersion is at a temperature within the above-specified range, it is possible to effectively advance the aggregation of the fine particles contained in the aqueous dispersion.

An aggregation terminating agent may be added after the particles being aggregated reaches a desired particle size. Examples of the aggregation terminating agent include sodium chloride, potassium chloride, and magnesium chloride. Through the above-described aggregation process, the aqueous dispersion of the aggregated particles can be obtained.

(Coalescing Process)

In the coalescing process, the components included in the aggregated particles obtained in the aggregation process are coalesced in the aqueous medium to give the toner cores 2. The components included in the aggregated particles can be coalesced by heating the aqueous dispersion containing the aggregated particles obtained in the aggregation process. Thus, an aqueous dispersion containing the toner cores 2 can be obtained.

In the coalescing process, the aqueous dispersion containing the aggregated particles is preferably heated at a temperature equal to or higher than (glass transition point (Tg) of the binder resin+10° C.)° C. and equal to or lower than the melting point of the binder resin. When the aqueous dispersion is heated at a temperature in the above-specified range, the coalescing of the components included in the aggregated particles can be effectively advanced.

The aqueous dispersion containing the toner cores 2 after the coalescing process may go through a washing process and a drying process described below as needed.

(Washing Process)

In the washing process, the toner cores 2 obtained through the coalescing process are washed with water, for example. An example of a method for washing the toner cores 2 involves collecting a wet cake of the toner cores 2 through solid-liquid separation from the aqueous dispersion containing the toner cores 2 and washing the wet cake with water. Another example of the method for washing the toner cores 2 involves precipitating the toner cores 2 in the aqueous dispersion containing the toner cores 2, substituting the supernatant with water, and then re-dispersing the toner cores 2 in water.

(Drying Process)

In the drying process, the toner cores 2 after the washing process are dried. Examples of a drier usable for the drying process include a spray dryer, a fluidized bed dryer, a vacuum freeze dryer, and a reduced pressure drier. So far, the toner core formation process has been described in detail.

<<Shell Layer Formation Process>>

Next, the shell layer formation process will be described. In the shell layer formation process, the shell layers 3 are formed on surfaces of the toner cores 2 prepared as described above to give the toner particles 1 including the toner cores 2 coated with the shell layers 3.

The shell layers 3 contain a thermosetting resin. The shell layers 3 can be formed by reacting melamine, urea, a reaction product of glyoxal and urea, or a precursor (methylol compound) generated through an addition reaction of formaldehyde and any of the above, for example. The shell layers 3 may be formed by reacting a monomer derived from a thermoplastic resin in addition to the above as needed. Preferably, the shell layers 3 are formed in a medium such as water. When such a medium as water is used, the binder resin can dissolve well in the medium, and elution of the releasing agent component in the toner cores 2 can be restricted.

In the shell layer formation process, materials for forming the shell layer 3 are added to and dispersed in the dispersion containing the toner cores 2 to form the shell layers 3. Examples of a method for well dispersing the toner cores 2 in the dispersion include a method by mechanically dispersing the toner cores 2 using a device capable of vigorously stirring the dispersion and a method by dispersing the toner cores 2 in an aqueous medium containing a dispersant. The above-mentioned methods allow the toner cores 2 to be dispersed homogeneously in an aqueous medium, and thus the shell layers 3 having a uniform thickness can be effectively formed.

Examples of the device capable of vigorously stirring the dispersion include HIVIS MIX (manufactured by PRIMIX Corporation).

(Dispersant)

Examples of the dispersant usable for dispersing the toner cores 2 in an aqueous medium include sodium polyacrylate, polyparavinyl phenol, partially saponified polyvinyl acetate, isoprene sulfonic acid, polyether, isobutylene-maleic anhydride copolymer, sodium polyaspartate, starch, gelatin, gum arabic, polyvinylpyrrolidone, and sodium lignosulfonate. These dispersants may be used independently, or two or more of these dispersants may be used in combination.

Preferably, the amount of the dispersant is 75 parts by mass or less relative to 100 parts by mass of the toner cores 2. When the amount of the dispersant is 75 parts by mass or less relative to 100 parts by mass of the toner cores 2, the total organic carbon in effluent can be reduced.

In addition, using the dispersant in the formation of the shell layers 3 allows the shell layers 3 to readily coat the surfaces of the toner cores 2 uniformly. The dispersant is attached to the surfaces of the toner cores 2, and thus the shell layers 3 are formed on the surfaces of the toner cores 2 with the dispersant interposed between the toner cores 2 and the shell layers 3. The dispersant interposed between the toner cores 2 and the shell layers 3 weakens the adhesion of the shell layers 3 to the toner cores 2. Accordingly, the films of the shell layers 3 may easily come off the toner cores 2 when the toner particles 1 are subjected to some mechanical stress. However, as long as the amount of the dispersant is 75 parts by mass or less relative to 100 parts by mass of the toner cores 2, the films of the shell layers 3 can be prevented from coming off the toner cores 2.

In the shell layer formation process, the aqueous dispersion containing the toner cores 2 is preferably adjusted to a pH of approximately 4. The dispersion is acidified to a pH of approximately 4 to accelerate a polycondensation reaction of the materials used for forming the shell layers 3. Preferably, the pH of the aqueous dispersion containing the toner cores 2 is adjusted before the materials for forming the shell layers 3 are added to the dispersion containing the toner cores 2.

After the pH of the aqueous dispersion containing the toner cores 2 is adjusted, the materials for forming the shell layers 3 are dissolved in the aqueous dispersion containing the toner cores 2. Thereafter, the materials for forming the shell layers 3 are reacted in the aqueous dispersion to give the shell layers 3 each coating the toner core 2.

In the shell layer formation process, the zeta potential of the toner particles 1 (specifically, the shell layers 3 formed as the surfaces of the toner particles 1) as measured in an aqueous medium adjusted to pH 4 is positive (specifically, higher than 0 mV). The zeta potential is preferably 0 mV or higher and 60 mV or lower, and more preferably 30 mV or higher and 40 mV or lower in order that the toner particles 1 are favorably cationic. The zeta potential of the toner particles 1 can be measured by the same method as in the above-described measurement of the zeta potential.

In the shell layer formation process, the shell layers 3 are preferably formed on the surfaces of the toner cores 2 at a reaction temperature of 55° C. or higher and 100° C. or lower. As long as the shell layer formation process is performed at a temperature in such a range, the shell layers 3 can be formed efficiently.

When the binder resin includes a resin having hydroxyl groups or carboxyl groups (e.g., polyester resin), and the shell layers 3 are formed at a temperature in such a range, hydroxyl groups or carboxyl groups exposed at the surfaces of the toner cores 2 react with the methylol groups of the thermosetting resin. Through the reaction, covalent bonding is formed between the binder resin forming the toner cores 2 and the resin forming the shell layers 3. As a result, the shell layers 3 can be firmly attached to the toner cores 2.

The shell layers 3 formed in the shell layer formation process have a film thickness of 1 nm or more and 20 nm or less, for example. Preferably, the shell layers 3 have a film thickness of 4 nm or more and 10 nm or less.

In the shell layer formation process, after the shell layers 3 are formed, the aqueous dispersion containing the toner cores 2 coated with the shell layers 3 is cooled to an ambient temperature to give a dispersion of the toner particles 1. Thereafter, a washing process, a drying process, and/or an external additive addition process is performed as needed, and then the toner particles 1 are collected from the dispersion of the toner particles 1. The toner particles 1 may be used as an electrostatic charge image developing toner. Alternatively, the toner particles 1 may be combined with other components to be used as an electrostatic charge image developing toner.

(Washing Process)

In the washing process, the toner particles 1 are washed with water. An example of a method for washing the toner particles 1 involves collecting a wet cake of the toner particles 1 through solid-liquid separation from the aqueous dispersion containing the toner particles 1 and washing the wet cake with water. Another example of the method for washing the toner particles 1 involves precipitating the toner particles 1 in the dispersion containing the toner particles 1, substituting the supernatant with water, and then re-dispersing the toner particles 1 in water.

The dispersant in the toner is removed through the washing process, and thus the organic components contained in the dispersant can be removed. The more the dispersant used, the more the water needed for washing the dispersant in the toner (eventually, the more wash effluent). By producing the toner particles 1 without using a dispersant, the total organic carbon concentration (TOC) in the filtrate and the wash effluent released can be kept at a level of 15 mg/L or lower without diluting the filtrate and the wash effluent with water. The total organic carbon concentration (TOC) can be measured using a total organic carbon concentration measuring device ("TOC-4200" manufactured by Shimadzu Corporation), for example.

An electrical conductivity measuring device can be used to facilitate the measurement of the washing level (level of toner washing) of the filtrate and the wash effluent collected through the washing process. Examples of the electrical conductivity measuring device include a conductivity meter ("Horiba COND METER ES-51" manufactured by HORIBA, Ltd.) The electrical conductivity of the filtrate and the wash effluent collected through the toner washing is measured to evaluate the level of organic substances remaining in the filtrate and the wash effluent collected through the toner washing. The target level of the electrical conductivity of the filtrate and the wash effluent collected through the toner washing as a level having no effect on the chargeability of the toner is 10 μS/cm or lower.

(Drying Process)

In the drying process, the toner particles 1 (toner mother particles) collected or washed are dried using a dryer (a spray dryer, a fluidized bed dryer, a vacuum freeze dryer, or a reduced pressure dryer), for example. It is preferable to use a spray dryer because it can effectively restrict aggregation of the toner particles being dried. When a spray dryer is used, it is possible to spray a dispersion of an external additive (e.g., silica fine particles) together with the dispersion of the toner mother particles. Thus, the later-described external additive addition process can be performed at the same time.

(External Additive Addition Process)

In the external additive addition process, an external additive is attached to the surfaces of the toner mother particles. An example of a method for attaching the external additive involves mixing the toner mother particles with the external additive using a mixer (e.g., an FM mixer or a Nauta (registered Japanese trademark) mixer) under conditions that prevent the external additive from being embedded in the surfaces of the toner mother particles.

So far, the electrostatic charge image developing toner of the present disclosure and the method for producing an electrostatic charge image developing toner have been described with reference to FIG. 1. The electrostatic charge image developing toner of the present disclosure and the toner obtained by the method for producing an electrostatic charge image developing toner of the present disclosure have excellent high-temperature preservability and excellent low-temperature fixability. Accordingly, the electrostatic charge image developing toner can be used in image forming apparatuses that employ electrophotography, electrography, or electrostatic printing.

EXAMPLES

Hereinafter, the present disclosure will be described in more detail by way of examples. It should be noted that the present disclosure is in no way limited to the scope of the examples.

Example 1

(Toner Core Formation Process)

A solution of polyoxyethylenated bisphenol A (ethylene oxide having a bisphenol A backbone) in an alcohol was reacted with an acid to give a polyester resin (PES 1) having the following properties. That is, the polyester resin (PES 1) had a hydroxyl value (OHV) of 20 mgKOH/g, an acid value (AV) of 40 mgKOH/g, a softening point (Tm) of 100° C., and a glass transition point (Tg) of 48° C. The polyester resin (PES 1) thus obtained was used as a binder resin. Then, 100 parts by mass of the polyester resin (PES 1), 5 parts by mass of a colorant (C.I. pigment blue 15:3 being a phthalocyanine pigment), and 5 parts by mass of a releasing agent (ester wax) were blended and mixed together using a mixer (FM mixer) to give a mixture. The mixture was melt-kneaded using a two screw extruder ("Model PCM-30" manufactured by Ikegai Corp.) to give a melt-kneaded product. The melt-kneaded product was coarsely pulverized into particles having a volume median diameter ($D_{50}$) of 6 μm using a mechanical pulverizer ("Turbo Mill" manufactured by FREUND-TURBO CORPORATION). The resulting coarsely pulverized product was classified using a classifier ("Elbow Jet" manufactured by Nittetsu Mining Co., Ltd.) to give toner cores. The toner cores had a volume median diameter ($D_{50}$) of 6 μm and a sphericity of 0.93. The volume median diameter ($D_{50}$) of the toner cores was measured using a particle size distribution measuring device ("Multisizer 3" manufactured by Beckman Coulter Inc.)

The triboelectric charge of the toner cores was measured using a negative-charging standard carrier (N-01) to be −20 μC/g. The zeta potential of the toner cores measured in a dispersion at pH 4 was −15 mV, showing that the toner cores were anionic. The toner cores had a glass transition point (Tg) of 49° C. and a softening point (Tm) of 90° C.

(Shell Layer Formation Process)

A one-liter three-necked flask having a thermometer, a stirring impeller, and a cooling tube was set in a water bath at 30° C. Then, 300 mL of ion exchanged water was poured into the flask, and the pH thereof was adjusted to 4 with an aqueous hydrochloric acid solution. To the resulting acid aqueous solution, 1.0 mL of an aqueous methylol melamine solution ("Mirbane (registered Japanese trademark) resin SM-607", having a solid concentration of 80% by mass, manufactured by Showa Denko K.K.) was added so that the shell layer would have a film thickness of 9 nm To the resulting aqueous solution, 300 g of the toner cores were added and sufficiently stirred. Ion exchanged water (300 mL) was further added to the aqueous solution, and the temperature of the aqueous solution in the flask was raised to 70° C. at a heating rate of 1° C./minute under stirring and maintained at the same temperature for 2 hours. Thereafter, sodium hydroxide was added into the flask thereby to adjust the content of the flask to pH 7 (neutralized). The content of the flask was cooled to an ambient temperature to give a dispersion containing toner particles (aqueous shell layer material solution A).

(Washing Process)

The dispersion containing the toner particles was filtered using a Buchner funnel to collect a wet cake of the toner particles (filtration process). The wet cake of the toner particles obtained through the filtration was dispersed in ion exchanged water to wash the toner particles (washing process). The same washing of the toner particles with ion exchanged water was repeated several times. Filtrate from the dispersion of the toner particles and wash effluent was collected.

The filtrate from the dispersion of the toner particles and the wash effluent had an electrical conductivity of 4 μS/cm regardless of the amount of the aqueous methylol melamine solution ("Mirbane (registered Japanese trademark) resin SM-607" manufactured by Showa Denko K.K.) added. The filtrate and the wash effluent after the formation of the shell layers of the toner had a total organic carbon (TOC) concentration of 8 mg/L or lower. The filtrate and the wash effluent was treated with a reverse osmosis (RO) membrane. As a result, the total organic carbon (TOC) concentration of the filtrate and the wash effluent was reduced to 3 mg/L or lower. That is, the filtrate and the wash effluent was clarified to a level of tap water.

(External Additive Addition Process)

Dry silica in an amount of 0.5% by mass relative to the mass of the toner particles (toner mother particles) was added to surfaces of the toner particles obtained as described above (external additive addition). Thus, an electrostatic charge image developing toner having a core-shell structure was obtained.

Example 2

An electrostatic charge image developing toner of Example 2 was obtained in the same manner as in Example 1 except that the amount of the aqueous methylol melamine solution ("Mirbane (registered Japanese trademark) resin SM-607" manufactured by Showa Denko K.K.) in the solution A was changed to 3.0 mL.

Example 3

An electrostatic charge image developing toner of Example 3 was obtained in the same manner as in Example 1 except that the amount of the aqueous methylol melamine solution ("Mirbane (registered Japanese trademark) resin SM-607" manufactured by Showa Denko K.K.) in the solution A was changed to 5.0 mL.

Example 4

An electrostatic charge image developing toner of Example 4 was obtained in the same manner as in Example 1 except that the amount of the aqueous methylol melamine solution ("Mirbane (registered Japanese trademark) resin SM-607" manufactured by Showa Denko K.K.) in the solution A was changed to 6.5 mL.

Example 5

An electrostatic charge image developing toner having a core-shell structure of Example 5 was obtained in the same manner as in Example 1 except that the binder resin was changed to another polyester resin (PES 3 having a hydroxyl value (OHV) of 4 mgKOH/g, an acid value (AV) of 8 mgKOH/g, a softening point (Tm) of 100° C., and a glass transition point (Tg) of 48° C.), that the amount of the aqueous methylol melamine solution ("Mirbane (registered Japanese trademark) resin SM-607" manufactured by Showa Denko K.K.) in the solution A was changed to 3.0 mL, and that the film thickness of the shell layer was changed to 6 nm.

Example 6

An electrostatic charge image developing toner having a core-shell structure of Example 6 was obtained in the same manner as in Example 1 except that the binder resin was changed to another polyester resin (PES 3 having a hydroxyl value (OHV) of 4 mgKOH/g, an acid value (AV) of 8 mgKOH/g, a softening point (Tm) of 100° C., and a glass transition point (Tg) of 48° C.), that the amount of the aqueous methylol melamine solution ("Mirbane (registered Japanese trademark) resin SM-607" manufactured by Showa Denko K.K.) in the solution A was changed to 3.0 mL, and that the film thickness of the shell layer was changed to 2 nm.

Example 7

An electrostatic charge image developing toner having a core-shell structure of Example 7 was obtained in the same manner as in Example 1 except that the binder resin was changed to another polyester resin (PES 4 having a hydroxyl value (OHV) of 20 mgKOH/g, an acid value (AV) of 60 mgKOH/g, a softening point (Tm) of 70° C., and a glass transition point (Tg) of 35° C.), and that the amount of the aqueous methylol melamine solution ("Mirbane (registered Japanese trademark) resin SM-607" manufactured by Showa Denko K.K.) in the solution A was changed to 3.0 mL.

Example 8

An electrostatic charge image developing toner of Example 8 was obtained in the same manner as in Example 1 except that the binder resin was changed to a styrene acrylate resin (StAc 1 having an acid value (AV) of 2 mgKOH/g, a softening point (Tm) of 100° C., and a glass transition point (Tg) of 48° C.), and that the amount of the aqueous methylol melamine solution ("Mirbane (registered Japanese trademark) resin SM-607" manufactured by Showa Denko K.K.) in the solution A was changed to 3.0 mL.

Comparative Example 1

An electrostatic charge image developing toner of Comparative Example 1 was obtained in the same manner as in Example 1 except that the amount of the aqueous methylol melamine solution ("Mirbane (registered Japanese trademark) resin SM-607" manufactured by Showa Denko K.K.) was changed to 7.0 mL.

Comparative Example 2

An electrostatic charge image developing toner of Comparative Example 2 was obtained in the same manner as in Example 1 except that the amount of the aqueous methylol melamine solution ("Mirbane (registered Japanese trademark) resin SM-607" manufactured by Showa Denko K.K.) was changed to 12.0 mL.

Comparative Example 3

An electrostatic charge image developing toner of Comparative Example 3 was obtained in the same manner as in Example 1 except that the aqueous methylol melamine solution ("Mirbane (registered Japanese trademark) resin SM-607" manufactured by Showa Denko K.K.) was not added and thus no shell layer was formed.

Comparative Example 4

An electrostatic charge image developing toner of Comparative Example 4 was obtained in the same manner as in Example 1 except that the binder resin was changed to another polyester resin (PES 2 having a hydroxyl value (OHV) of 5 mgKOH/g, an acid value (AV) of 10 mgKOH/g, a softening point (Tm) of 130° C., and a glass transition point (Tg) of 58° C.), and that the aqueous methylol melamine solution ("Mirbane (registered Japanese trademark) resin SM-607" manufactured by Showa Denko K.K.) was not added and thus no shell layer was formed.

Comparative Example 5

An electrostatic charge image developing toner having a core-shell structure of Comparative Example 5 was obtained in the same manner as in Example 1 except that the binder resin was changed to a styrene acrylate resin (StAc 1), and that the amount of the aqueous methylol melamine solution ("Mirbane (registered Japanese trademark) resin SM-607" manufactured by Showa Denko K.K.) was changed to 2.0 mL.

Comparative Example 6

An electrostatic charge image developing toner having a core-shell structure of Comparative Example 6 was obtained in the same manner as in Example 1 except that the amount of the aqueous methylol melamine solution ("Mirbane (registered Japanese trademark) resin SM-607" manufactured by Showa Denko K.K.) was changed to 0.2 mL.

Hereinafter, methods for measuring and evaluating the electrostatic charge image developing toners obtained in the examples and the comparative examples will be described.

(Glass Transition Point (Tg) of Binder Resin Contained in Toner Cores)

A heat absorption curve of the binder resin used in each of the examples and the comparative examples was obtained as follows using a differential scanning calorimeter (DSC). As a measurement sample, the binder resin (10 mg) was put in an aluminum pan. An empty aluminum pan was used as a reference. The binder resin was measured within a temperature range of 25° C. to 200° C. at a heating rate of 10° C./minute to obtain a heat absorption curve of the binder resin. The glass transition point Tg (° C.) of the binder resin contained in the toner cores was determined based on the heat absorption curve thus obtained.

(Softening Point (Tm) of Binder Resin Contained in Toner Cores)

The softening point of each binder resin was measured using a capillary rheometer ("CFT-500D" manufactured by Shimadzu Corporation) as follows. Specifically, each binder resin as a measurement sample was set in the capillary rheometer. A measurement sample having a volume of 1 $cm^3$ was allowed to melt-flow under a specified condition (die pore size: 1 mm, plunger load: 20 $kg/cm^2$, heating rate: 6° C./minute) to obtain an S-shaped curve (i.e., an S-shaped curve relating temperature (° C.) to stroke (mm)) The softening point (Tm) of the binder resin contained in the toner cores was read from the S-shaped curve obtained.

(Method for Measuring Zeta Potential of Toner Cores)

The zeta potential of the toner cores obtained in each of the examples and the comparative examples was measured at 23° C. using a zeta potential measuring device ("ELSZ-1000" manufactured by Otsuka Electronics Co., Ltd.) A measurement sample was prepared as follows. First, 1 g of the toner cores were added to 100 g of ion exchanged water in which 0.1% by mass of a nonionic surfactant ("EMULGEN 120" manufactured by Kao Corporation) had been dissolved. Then, the resulting solution was exposed to ultrasound waves for 3 minutes and mixed to give a toner core dispersion in which the toner cores were homogeneously dispersed. A 1N aqueous hydrochloric acid solution or a 1N aqueous sodium hydroxide solution was added to the toner core dispersion to adjust the pH of the toner core dispersion to a desired pH value (pH 4). The zeta potential of the toner core dispersion whose pH was adjusted was measured once the pH reached a desired pH (pH 4) and became stable. The same measurement was performed three times for one measurement sample, and an average of the three measurement values was determined as the zeta potential of the sample. Next, the isoelectric pH of the toner core dispersion was determined (adjusted), and thus a desired toner core dispersion was prepared as a measurement sample.

Hereinafter, an appropriate isoelectric point of the toner core dispersion in the shell layer formation will be described. When the isoelectric point of the toner core dispersion is lower than 4.5, films of the shell layers are not likely to be formed sufficiently. Consequently, the resulting electrostatic charge image developing toner is not expected to have desired low-temperature fixability or high-temperature preservability. When the isoelectric point of the toner core dispersion is 4.5 or higher, films of the shell layers are likely to be formed sufficiently. Consequently, the resulting electrostatic charge image developing toner is expected to have desired low-temperature fixability and high-temperature preservability.

(Method for Measuring Zeta Potential of Toner Particles)

The zeta potential of the toner particles (equivalent to the zeta potential of the shell layers) obtained in each of the examples and the comparative examples was measured in the same manner as in the measurement of the zeta potential of the toner cores except that the toner particles were used as a measurement sample instead of the toner cores.

(Method for Measuring Sphericity of Toner Cores)

The sphericity of 3000 toner cores obtained in each of the examples and the comparative examples was measured using a flow particle image analyzer ("FPIA (registered Japanese trademark) 3000" manufactured by Sysmex Corporation). An average of the sphericity values obtained was determined as the sphericity of the toner cores.

(Method for Measuring Sphericity of Toner Particles)

The sphericity of the toner particles (equivalent to the sphericity of the shell layers) obtained in each of the examples and the comparative examples was measured in the same manner as in the measurement of the sphericity of the toner cores except that the toner particles were used as a measurement sample instead of the toner cores.

(Method for Measuring Triboelectric Charge of Toner Cores)

A negative-charging standard carrier (N-01) available from The Imaging Society of Japan was mixed with the toner cores obtained in each of the examples and the comparative examples in an amount of 7% by mass relative to the mass of the carrier. The resulting mixture was mixed for 30 minutes using a TURBULA mixer to give a developer. The triboelectric charge of the toner cores in the developer was measured using a Q/m meter ("Model 210HS-2A" manufactured by TREK, INC.) Toner cores negatively charged to have a triboelectric charge of less than 0 μC/g was defined as anionic toner cores.

(Method for Measuring Triboelectric Charge of Toner Particles)

A positive-charging standard carrier (P-01) available from The Imaging Society of Japan was mixed with the toner (toner containing toner particles) obtained in each of the examples and the comparative examples in an amount of 7% by mass relative to the mass of the carrier. The resulting mixture was mixed for 30 minutes using a TURBULA mixer to give a developer. The triboelectric charge of the toner particles (equivalent to the triboelectric charge of the shell layers) in the developer was measured using a Q/m meter (Model 210HS-2A manufactured by TREK, INC.) Toner particles positively charged to have a triboelectric charge of greater than 0 μC/g was defined as cationic toner particles.

(Method for Evaluating Toner Aggregation)

A carrier ("VB59L" manufactured by Powdertech Co., Ltd.) was mixed with the toner (toner containing toner particles) obtained in each of the examples and the comparative examples in an amount of 8% by mass relative to the mass of the carrier. The resulting mixture was mixed for 30 minutes using a TURBULA mixer to give a developer. The developer was poured into a developing device of a color printer ("FS-C5250DN" manufactured by KYOCERA Document Solutions Inc.) The color printer was driven at 50° C. for 1 hour, and then the developer was taken out of the developing device. The developer taken out was sifted through a sieve having an opening of 78 μm using a vibratory sieving machine ("powder tester" manufactured by Hosokawa Micron Corporation) at a rheostat level of 5 for 30 seconds. Based on the mass of the developer remaining on the sieve after the sifting and the mass of the developer before the sifting, a rate of remaining developer (% by mass) was determined in accordance with the equation shown below. Based on the rate of remaining developer, toner aggregation was evaluated in accordance with the following criteria. The results of the evaluation of the toner aggregation are shown in Table 3. Rate of remaining developer (% by mass)=(mass of developer remaining on sieve after sifting/mass of developer before sifting)×100

No: Rate of remaining developer of 1.0% by mass or lower

Yes: Rate of remaining developer of higher than 1.0% by mass (Method for Evaluating Blocking Resistance of Toner)

To a 20-mL plastic bottle, 3 g of the toner containing the toner particles obtained in each of the examples and the comparative examples was added. The plastic bottle was left to stand in a constant temperature bath at 60° C. for 3 hours. Thus, a toner for the blocking resistance evaluation was obtained. Thereafter, the toner for the blocking resistance evaluation was sifted through a 200-mesh sieve (opening: 75 μm) using a vibratory sieving machine ("powder tester" manufactured by Hosokawa Micron Corporation) at a rheostat level of 5 for 30 seconds. Based on the mass of the toner remaining on the sieve after the sifting and the mass of the toner before the sifting, a rate of remaining toner (% by mass) was determined in accordance with the equation shown below. Based on the rate of remaining toner thus determined, the blocking resistance of the toner was evaluated according to the following criteria. The rate of remaining toner (% by mass) and results of the blocking resistance evaluation are shown in Table 3.

Rate of remaining toner(% by mass)=(mass of toner remaining on sieve after sifting/mass of toner before sifting)×100

Very good (VG): Rate of remaining toner of lower than 15% by mass

Good (G): Rate of remaining toner of 15% by mass or higher and 20% by mass or lower Poor (P): Rate of remaining toner of higher than 20% by mass (Method for Evaluating Low-Temperature Fixability)

The lowest fixing temperature of the toner obtained in each of the examples and the comparative examples was measured using a Roller-Roller type heat pressure fixing unit. A nip having a width of 8 mm was formed at a rate of 200 mm/second, and the temperature of a fixing roller was raised from 100° C. to 200° C. in increments of 5° C. A temperature of the fixing roller at which a fixing ratio of 90% or higher was reached under the above-specified conditions was determined as the lowest fixing temperature. The toner was fixed to paper at a toner supplying rate of 90 $g/m^2$ and a toner load of 1.0 $mg/cm^2$ while the paper was caused to pass through the nip over 40 milliseconds. Based on the lowest fixing temperature obtained as described above, the low-temperature fixability of the toner was evaluated according to the following criteria. The lowest fixing temperature (° C.) and results of the low-temperature fixability evaluation are shown in Table 3.

Very Good (VG): Lowest fixing temperature of lower than 150° C.

Good (G): Lowest fixing temperature of 150° C. or higher and 160° C. or lower

Poor (P): Lowest fixing temperature exceeding 160° C.

(Method for Evaluating Level of Toner Washing)

The electrical conductivity of the filtrate and the wash effluent collected through the washing of the toner obtained in each of the examples and the comparative examples was measured using a conductivity meter ("Horiba COND METER ES-51" manufactured by HORIBA, Ltd.) in order to evaluate the level of the toner washing. The toner was washed until the electrical conductivity of the filtrate and the wash effluent collected through the washing of the toner was 10 μS/cm or lower, which is a level having no effect on the chargeability of the toner.

(Method for Evaluating Organic Substances in Filtrate and Wash Effluent)

Organic substances derived from an unreacted monomer or prepolymer, or a dispersant or activating agent in the filtrate and the wash effluent collected through the washing of the toner (toner containing the toner particles) can be measured by determining the biochemical oxygen demand (BOD) or the chemical oxygen demand (COD), for example. In the present examples, however, the total organic carbon (TOC) in the filtrate and the wash effluent collected through the washing of the toner was measured using a total organic carbon measuring device ("TOC-4200" manufactured by Shimadzu Corporation) for performing overall measurement of organic substances in a stable manner. The amount of organic substances of the total organic carbon (TOC) in the filtrate and the effluent collected through the washing of the toner was measured using this device. The device allows measurement of up to approximately 3 mg/L of organic substances in the filtrate and the wash effluent collected through the washing of the toner. The above-described measurement takes less time than the generally employed measurement of biochemical oxygen demand (BOD) or chemical oxygen demand (COD).

(Method for Evaluating Cross-Sectional Form of Toner Particles)

Hereinafter, a method for measuring the film thickness of the shell layers constituting the surfaces of the toner cores will be described. The toner obtained in each of the examples and the comparative examples (toner containing toner particles encapsulated and having dry silica attached thereto) was dispersed in a cold-setting epoxy resin. The epoxy resin containing the toner was left to stand at 40° C. for 2 days to be sufficiently cured. Thus, a cured toner-containing epoxy resin was obtained. The cured toner-containing epoxy resin was dyed with osmium tetroxide. A slice toner particle measurement sample having a thickness of 200 nm was cut from the cured dyed epoxy resin using a microtome (Ultramicrotome, "EM UC6" manufactured by Leica Microsystems) having a diamond knife. The resulting slice measurement sample was observed using a transmission electron microscope (TEM, "JSM-6700F" manufactured by JEOL Ltd.) at magnifications of ×3000 and ×10000, and thus cross-sectional forms of the toner particles were observed. Thereafter, TEM images of the measurement sample observed as described above were captured.

(Method for Measuring Film Thickness of Shell Layers)

The thickness of the shell layers was measured by analyzing the TEM images using image-analyzing software ("WinROOF" manufactured by Mitani Corporation). More specifically, on the cross-section of a toner particle, two straight lines were drawn to intersect at right angles at approximately the center of the cross-section. Lengths of segments of the two lines crossing the shell layer were measured at four locations. An average value of the lengths measured at the four locations was determined to be the thickness of the shell layer of the one toner particle measured. The same measurement of the thickness of the shell layer was performed on ten toner particles to obtain the thicknesses of the shell layers of the respective toner particles. An average value of the thicknesses thus obtained was determined as the thickness of the shell layers.

When the thickness of a shell layer is less than 5 nm, it may be difficult to measure the thickness only by the above-described TEM imaging. In this case, the TEM imaging and energy dispersive X-ray spectroscopic analysis (EDX) were combined to perform elemental mapping of nitrogen on a TEM image. Thus, the boundary between the shell layer and the toner core was clarified, and the thickness of the shell layer was measured.

Tables 1 to 3 show results of the evaluations on the electrostatic charge image developing toners obtained in the examples and the comparative examples.

TABLE 1

| | Toner cores | | | | | | |
|---|---|---|---|---|---|---|---|
| | Binder resin | Sphericity | Glass transition point [° C.] | Softening point [° C.] | Triboelectric charge value [μC/g] | Zeta-potential [mV] | Toner core amount in shell layer formation process [g] |
| Example 1 | PES 1 | 0.93 | 49 | 90 | −20 | −15 | 300 |
| Example 2 | PES 1 | 0.93 | 49 | 90 | −20 | −15 | 300 |
| Example 3 | PES 1 | 0.93 | 49 | 90 | −20 | −15 | 300 |
| Example 4 | PES 1 | 0.93 | 49 | 90 | −20 | −15 | 300 |
| Example 5 | PES 3 | 0.94 | 49 | 90 | −6 | −6 | 300 |
| Example 6 | PES 3 | 0.94 | 49 | 90 | −4 | −4 | 300 |
| Example 7 | PES 4 | 0.93 | 34 | 68 | −20 | −15 | 300 |
| Example 8 | StAc 1 | 0.93 | 49 | 90 | −10 | −10 | 300 |
| Comparative Example 1 | PES 1 | 0.93 | 49 | 90 | −20 | −15 | 300 |
| Comparative Example 2 | PES 1 | 0.93 | 49 | 90 | −20 | −15 | 300 |
| Comparative Example 3 | PES 1 | 0.93 | 49 | 90 | −20 | −15 | 300 |
| Comparative Example 4 | PES 2 | 0.94 | 57 | 110 | −20 | −15 | 300 |
| Comparative Example 5 | StAc 1 | 0.93 | 49 | 90 | 10 | 20 | 300 |
| Comparative Example 6 | PES 1 | 0.93 | 49 | 90 | −20 | −15 | 300 |

TABLE 2

| | Shell layers | | | | |
|---|---|---|---|---|---|
| | Amount of aqueous methylol-melamine solution [mL] | Film thickness [nm] | Sphericity | Tribo-electric charge value [μC/g] | Zeta-potential [mV] |
| Example 1 | 1.0 | 3 | 0.96 | 40 | 20 |
| Example 2 | 3.0 | 9 | 0.97 | 45 | 30 |
| Example 3 | 5.0 | 15 | 0.97 | 47 | 32 |
| Example 4 | 6.5 | 20 | 0.98 | 50 | 35 |
| Example 5 | 3.0 | 6 | 0.98 | 35 | 30 |
| Example 6 | 3.0 | 2 | 0.98 | 35 | 15 |
| Example 7 | 3.0 | 9 | 0.98 | 30 | 30 |
| Example 8 | 3.0 | 9 | 0.97 | 45 | 20 |
| Comparative Example 1 | 7.0 | 22 | 0.98 | 55 | 35 |
| Comparative Example 2 | 12.0 | 35 | 0.98 | 60 | 40 |
| Comparative Example 3 | — | — | — | — | — |
| Comparative Example 4 | — | — | — | — | — |
| Comparative Example 5 | 2.0 | 0.1 | 0.97 | 30 | 10 |
| Comparative Example 6 | 0.2 | 0.5 | 0.98 | −10 | −15 |

TABLE 3

| | Toner | | | | |
|---|---|---|---|---|---|
| | | Blocking resistance | | Low-temperature fixability | |
| | Toner aggregation | Rate of remaining toner [% by mass] | Evaluation | Lowest fixing temperature [° C.] | Evaluation |
| Example 1 | No | 16 | G | 140 | VG |
| Example 2 | No | 8 | VG | 150 | VG |
| Example 3 | No | 7 | VG | 155 | G |
| Example 4 | No | 5 | VG | 160 | G |
| Example 5 | No | 12 | VG | 135 | VG |
| Example 6 | No | 18 | G | 135 | VG |
| Example 7 | No | 20 | G | 135 | VG |
| Example 8 | No | 8 | VG | 150 | VG |
| Comparative Example 1 | No | 3 | VG | 170 | P |
| Comparative Example 2 | No | 2 | VG | 180 | P |
| Comparative Example 3 | Yes | 98 | P | 135 | VG |
| Comparative Example 4 | Yes | 10 | VG | 180 | P |
| Comparative Example 5 | Yes | 98 | P | 180 | P |
| Comparative Example 6 | Yes | 98 | P | 135 | VG |

As obvious from Tables 1 to 3, the electrostatic charge image developing toners obtained in Examples 1 to 8 were excellent in high-temperature preservability (blocking resistance), low-temperature fixability, and chargeability.

The amount of the aqueous methylol melamine solution added as a material of the thermosetting resin for forming the shell layers was 6.5 mL in Comparative Example 1, 12.0 mL in Comparative Example 2, which was larger than that in Examples 1 to 8. Consequently, the thickness of the shell layers of the toner particles contained in the toners obtained in Comparative Examples 1 and 2 was 20 nm or more. As a result, the lowest fixing temperature of the toner in Comparative Example 1 was 170° C., and the lowest fixing temperature of the toner in Comparative Example 2 was 180° C., which were higher than those of the toners in Examples 1 to 8. Consequently, the toners in Comparative Examples 1 and 2 were poor in low-temperature fixability.

The toners obtained in Comparative Examples 3 and 4 contained no aqueous methylol melamine solution as a material of the thermosetting resin. As a result, no shell layer was formed on the surfaces of the toner cores. Consequently, the toner cores were aggregated, and therefore the toner in Comparative Example 3 was poor in high-temperature preservability (blocking resistance) compared to the toners in Examples 1 to 8. The toner in Comparative Example 4 was poor in low-temperature fixability.

In the toner obtained in Comparative Example 5, the surfaces of the toner cores had a positive charge (triboelectric charge value and zeta potential). Consequently, the toner cores and the resin in the shell layers were aggregated, and therefore the toner in Comparative Example 5 was poor in high-temperature preservability (blocking resistance) compared to the toners in Examples 1 to 8.

In the toner obtained in Comparative Example 6, the shell layers coating the toner cores had a film thickness of as small as 0.5 nm. It is therefore expected that the surfaces of the toner cores tend to be exposed at the shell layers. Consequently, the toner particles were aggregated, and therefore the toner in Comparative Example 6 was poor in high-temperature preservability (blocking resistance) compared to the toners in Examples 1 to 8.

What is claimed is:

1. An electrostatic charge image developing toner containing a plurality of toner particles, the toner particles each including a toner core containing a binder resin and a shell layer coating the toner core, the binder resin containing a polyester resin, the shell layers containing a melamine resin, the toner cores having a negative zeta potential in an aqueous medium adjusted to pH 4, the toner particles having a positive zeta potential in an aqueous medium adjusted to pH 4, the shell layers having a film thickness of 1 nm or more and 20 nm or less.

2. An electrostatic charge image developing toner according to claim 1, wherein the binder resin has a glass transition point equal to or lower than a cure onset temperature of the melamine resin contained in the shell layers.

3. An electrostatic charge image developing toner according to claim 1, wherein the toner cores have a glass transition point of 25° C. or higher and 55° C. or lower.

4. An electrostatic charge image developing toner according to claim 1, wherein the shell layers have a film thickness of 4 nm or more and 10 nm or less.

5. An electrostatic charge image developing toner according to claim 1, wherein the binder resin has a solubility parameter of 10 or more.

* * * * *